United States Patent [19]

Bauder

[11] 4,131,108

[45] Dec. 26, 1978

[54] ANDIRON FOR SUPPORTING LOGS

[76] Inventor: Edward M. Bauder, 3807 E. Georgia St., Burnaby, B. C., Canada, V5C 257

[21] Appl. No.: 759,876

[22] Filed: Jan. 17, 1977

[51] Int. Cl.[2] ..... F24B 13/00

[52] U.S. Cl. ..... 126/298; 182/181; 211/60 R; D7/211; D23/97

[58] Field of Search ..... 126/164, 165, 201, 298, 126/336; D7/207, 211; D23/94, 95, 96, 97; 108/91; 211/60 R; 182/181, 224, 17

[56] References Cited

U.S. PATENT DOCUMENTS

| | | | |
|---|---|---|---|
| D. 209,258 | 11/1967 | McDonald | D7/207 |
| 544,715 | 8/1895 | Young | 126/298 |
| 3,838,679 | 10/1974 | Welch | 126/165 |

*Primary Examiner*—Ronald C. Capossela
*Attorney, Agent, or Firm*—Carver and Company

[57] ABSTRACT

Andiron for supporting logs on a hearth in two primary fuel banks disposed in an inverted V-position to form triangular opening facing room to be heated. Andiron has horizontal baffle member supported above and between spaced positioning members by frame means. Baffle member and positioning members on each side of andiron are positioned so that primary fuel banks extend between edges of baffle member and positioning members so as to be inclined at particular angles with banks almost touching at apex. Secondary fuel placed between lower ends of primary fuel banks when ignited cooperates with primary fuel to form a concentrated, triangular-sectioned combustion zone of essentially uniform temperature defined by burning faces of primary and secondary fuel. Primary fuel burns mostly on inner faces with negligible burning of outer faces which reduces convection losses up the chimney. The inner faces of primary fuel banks and burning secondary fuel provides three radiating surfaces which tend to sustain combustion of oppositely facing radiant surfaces by absorption and re-radiation of radiant heat between the surfaces.

10 Claims, 5 Drawing Figures

11
57
56
56
37
23
12
16
31
38
19
25
22
33
51
26
21
32
10
34
15

23
52
48
37
38
22
46
47
29
21
31
26
25
33
10, 19
59
21, 28
32
34

ANDIRON FOR SUPPORTING LOGS

BACKGROUND OF THE INVENTION

1. Field of the Invention

The invention relates to an andiron for supporting logs on a domestic fireplace hearth.

2. Prior Art

It is well known that open domestic fireplaces using common basket type grates to support fuel are relatively ineffective for heating a room. Common grates suspend the fuel a short distance above the hearth to increase air flow through the fuel, but such grates remove heat by conduction and set up convection currents which pass heat up the chimney. Sides of the grate also restrict radiation of heat into the room from high temperature portions of the fire.

Some mechanical devices are available to improve heat transfer to the room, one example being a double walled fireplace that circulates air into the room from spaces between the double walls to improve heat transfer, but this type of device is expensive to construct and cannot be easily incorporated into an existing fireplace. Tubular grates to support fuel and to heat air passing through the tubes into the room can be fitted into an existing fireplace, but detract from the appearance of the fireplace and also cool the fire to the detriment of combustion. It is considered that a major factor contributing to the inefficiency of common fireplaces is that most of the heat that is transfered to the room is transfered by radiation, but typically the portion transfered by radiation is only a small portion of the total heat from the fire. The remaining heat is removed from the fire by conduction and convection, most of which tends to escape up the chimney. Furthermore a portion of heat radiated from the fire is radiated to walls of the fireplace, which is then lost because convection currents cool the heated walls and pass up the chimney.

It has already been recognized that if the proportion of radiant heat transfer is increased, the heat radiated to the room will increase, thus increasing effectiveness of the fire. Andirons or grates have been designed to hold fuel so that a greater portion of heat is transfered to the room by radiation from the burning surfaces thereof, but when using some of these devices it has been found that sometimes it is difficult to maintain satisfactory combustion and effective radiation over extended periods of time.

SUMMARY OF THE INVENTION

The present invention provides an andiron with improved control of combustion of the fuel, which reduces heat loss up the chimney by convection currents, and improves radiation of heat of combustion directly into the room to be heated. Furthermore a relatively large fire is not required to produce a large radiant heat source, and commonly the fire is easy to light and requires little attention after initial lighting.

An andiron according to the invention supports on a hearth first and second primary fuel banks in an inverted V-position, and has a baffle member, positioning members and frame means. The baffle member is spaced at a baffle height above the hearth and has spaced, generally horizontally disposed first and second edges which define a baffle width of between about 25 and 50% of the baffle height. First and second positioning members are positioned below the baffle member and are spaced laterally relative to each other and the baffle member. The frame means connect the baffle member to the positioning members so as to form a self-supporting framework having at least one open end, and in which the baffle member and first positioning member on one side of the frame are positioned so that the first fuel bank extends between the first edge of the baffle member and the positioning member, and is inclined to the vertical at an angle of inclination of between 15° and 30°. The second positioning member on the opposite side of the frame is positioned relative to the second edge of the baffle member so as to support the second fuel bank on the opposite side of the frame at a similar angle. When correctly supported on the andiron, the fuel banks form a generally inverted V.

In operation, secondary fuel is placed on the hearth between the inclined primary fuel banks so as to leave air passages between the primary and secondary fuel and the baffle member. The air passages and the space above the baffle member between the inclined fuel banks form a triangular-sectioned combustion zone. Combustion is established on opposite faces of the primary and secondary fuel and heat is radiated between the burning faces to maintain combustion and radiate heat to room. Most of burning takes place on inner faces of primary fuel with negligible burning on the outer faces, thus reducing convection losses up the chimney.

A detailed disclosure following, related to drawings, describes a preferred embodiment of the invention which is capable of expression in structure other than that particularly described and illustrated.

DETAILED DISCLOSURE

Figure 1:
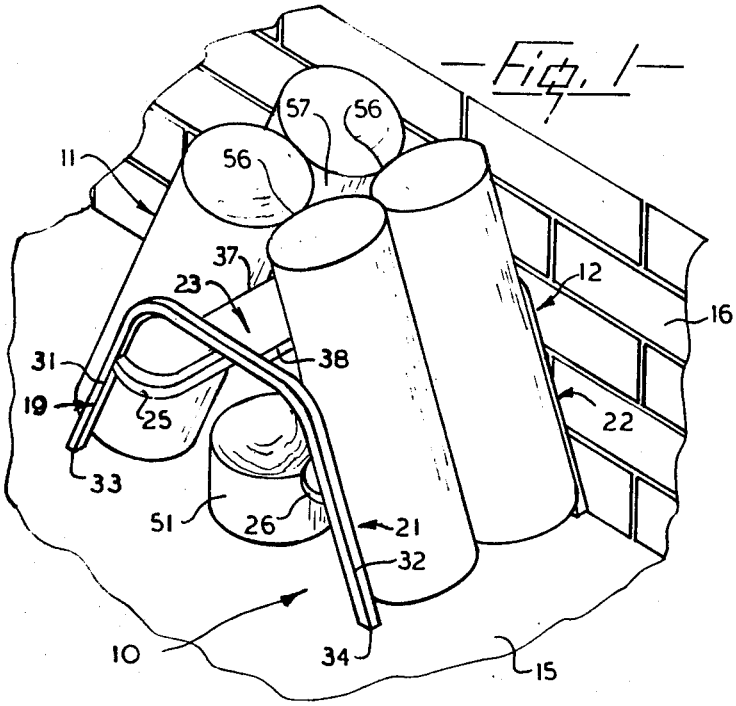
FIG. 1 is a fragmented perspective of an andiron according to the invention supporting four logs in a hearth to serve as primary fuel banks.
Figure 2:
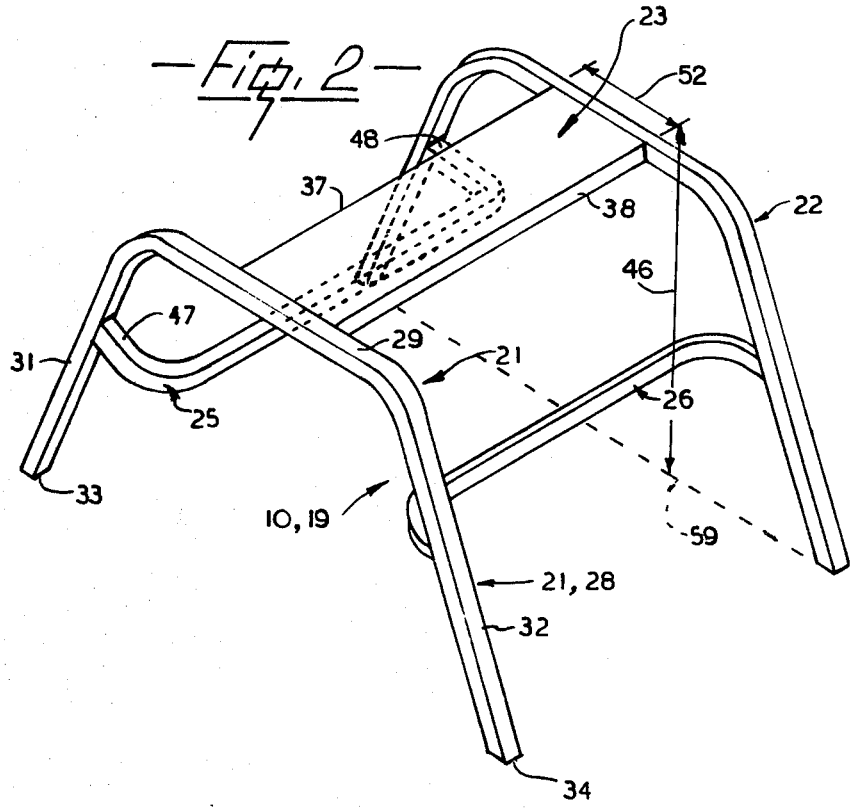
FIG. 2 is a perspective of the andiron of FIG. 1, the logs being removed.
Figure 3:
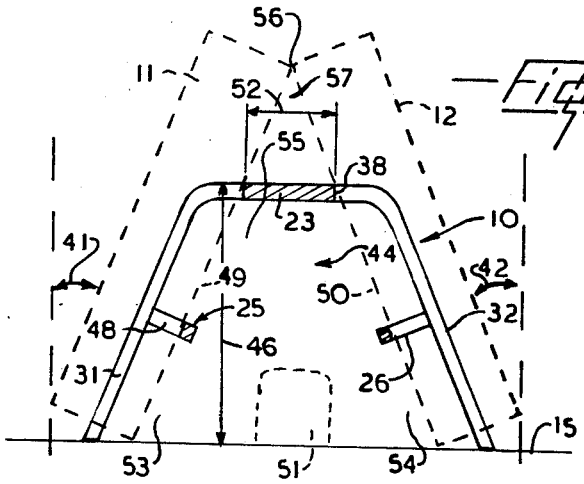
FIG. 3 is a fragmented elevation of the andiron of FIG. 1 showing logs supported thereon.

FIGS. 1 through 3

An andiron 10 according to the invention supports first and second pairs of logs 11 and 12 on opposite sides thereof. The andiron stands on a hearth 15 and is adjacent a vertical fireplace rear wall 16. Oppositely facing fireplace side walls are not shown and these can be some distance from the andiron and logs. The andiron has a frame means 19 which includes a pair of similar open frame members 21 and 22, a baffle member 23 and first and second spaced positioning members 25 and 26. The frame member 21 is a truncated, generally inverted V-shaped bar 28 having an upper portion 29, and similar leg portions 31 and 32 with lower ends 33 and 34 respectively. The frame member 22 is similar and thus the two members 21 and 22 together form a frame means having a pair of similar open frame members which each include generally downwardly curved bars which extend to the lower ends thereof. The lower ends of the two frame members are disposed within a horizontal plane and are adapted to contact the hearth 15 for supporting the andiron thereon.

The baffle member 23 a generally horizontally disposed, rectangular plate which extends between upper portions of the frame members and has spaced first and second horizontal edges 37 and 38 which support the log pairs thereon. The first and second positioning members 25 and 26 extend between leg portions of the frame members and are positioned below the baffle member. The members 25 and 26 are spaced laterally relative to each other and the baffle member so that the first positioning member on one side of the frame is positioned so that the log pair 11 extends between and is supported on the first edge 37 of the baffle member and the positioning member and is inclined to the vertical at an angle of inclination 41, FIG. 3 only, which is between 15° and 30°. The second positioning member 26 on the opposite side of the andiron is positioned relative to the second edge 38 of the baffle member so as to support the second log pair on the opposite side of the frame at a similar angle 42. Thus when the logs are correctly supported on the andiron the logs form a generally inverted V which, together with the hearth 15, defines a triangular shaped combustion zone 44 therebetween.

The positioning member 25 has upwardly and outwardly turned end portions 47 and 48 secured to the frame members so that the positioning member extends downwardly and inwardly from the frame member. This forms a cradle in which the pair of logs 11 is supported and the end portions restrict lateral movement of the logs supported thereon. As best seen in FIG. 3, when supported on the respective edge of the baffle member and the respective positioning member, the log pairs are inclined so as to be parallel to the adjacent leg portions which similarly restrict lateral movement of the logs. The positioning member 26 has similar end portions and thus it can be seen that the end portions of the positioning members serve as means adjacent ends of the positioning members to restrict lateral movement of the logs supported on the positioning members.

Referring to FIGS. 1 and 3, two pairs of logs 11 and 12 in an inverted V-position serve as first and second primary fuel banks. FIG. 1, shows two log pairs of the same size and shape, such as common round, uniform artificial logs made from compressed wood waste. Other fuel can be substituted, for example several small logs of different sizes may be used to fill the spaces on each side of the andiron to form two primary fuel banks that touch or nearly touch at the apex and are inclined at the desired angle. The material may also be newspapers rolled into "logs" of up to five inches in diameter. Whatever material forms the primary fuel banks, there should be no large gaps in either side so that inner faces 49 and 50 of the first and second fuel banks present essentially unbroken surfaces which when burning form radiant faces. Secondary fuel 51 is placed on the hearth 15 between the primary fuel so as to form air spaces 53, 54 and 55 within a lower portion of the combustion zone 44 below the baffle member. An air space 57 above the baffle member and between upper ends of the primary fuel banks is adjacent an apex 56 of the fuel banks, ie where upper inner corners of the fuel banks touch or almost touch each other.

The volume and shape of the secondary fuel is chosen so that the air spaces 53 and 54 are left between the primary and secondary fuel and the air space 55 is left between the secondary fuel and the baffle member. These three spaces and the space 57 above the baffle plate between the primary fuel banks form the triangular shaped combustion zone 44. Varying the volume of secondary fuel varies the characteristics of combustion and provides a means of compensating for the type of fuel used, its moisture content and the fireplace draw. A little experimentation may be necessary to ascertain the best volume of secondary fuel which, once correctly selected, may require occasional replenishment during the combustion of the primary fuel. FIGS. 1 and 3 show secondary fuel of short blocks of the logs made from compressed wood waste, but the secondary fuel can be logs that are approximately the length of the baffle plate — or even lumps of coal.

OPERATION

In operation, when using logs made from compressed wood waste the two primary fuel banks are established by setting up preferrably two logs on each side of the andiron so that the logs are supported on the hearth 15, the first and second edges of the baffle member and the first and second positioning members. Secondary fuel is placed on the hearth under the baffle member and between the primary fuel banks. Kindling and paper are placed in the combustion zone and lit and, usually after a few minutes, combustion of the primary and secondary fuel commences and the convection currents thus set up cause the combustion air to flow up the inner faces of the primary fuel banks to escape adjacent the apex. Because the inclination of the fuel produces more than adequate draft the baffle member reduces the flow of air through the combustion zone and increases turbulence in the flow. This controls air flow and turbulence to an amount which causes almost all the oxygen to be completely removed from the combustion gases and reduces the flow of gases up the chimney.

At the proper angle of inclination of the primary fuel, burning occurs only on the inner faces 49 and 50 of the primary fuel banks adjacent the andiron, and the outer faces of the primary fuel banks remain relatively cool so that radiation to the fireplace and convection currents flowing over the outer faces of the fuel banks are relatively insignificant. Much of the radiant heat generated on one burning inner face of one primary fuel bank is radiated to the opposite burning inner face of the primary fuel bank, the secondary fuel, the baffle member or the rear wall of the fireplace so that a high temperature, relatively stable and uniform fire is maintained throughout the combustion zone. Thus there is absorption of radiant heat from an opposite burning face, which heat is re-radiated back into the combustion zone so as to increase temperature within the combustion zone. Since only a little heat escapes laterally through the primary fuel banks, the temperature of the burning surfaces must rise and heat escapes from the combustion zone only by radiation directly into the room through the opening at the front. It is a well known principle of physics that the radiant heat depends on the fourth power of the temperature, and if heat cannot otherwise escape, the temperature will rise until the heat is transferred into the room by radiation. Thus in effect the primary fuel banks serve also as thermal insulators to reduce heat losses by conduction and convection which inevitably results in a higher transfer of heat by radiation. When operating properly, from the room the fire within the combustion zone appears as a fairly uniform red triangular area defined partially by unburnt outer surfaces of the primary fuel banks.

Because the primary fuel burns from one side only, it tends to produce a long-lasting fire which burns uniformly with little attention. As the fuel burns, the inner faces 49 and 50 of the primary fuel banks are burned away gradually and weight of the remaining portions of the primary fuel tends to move the primary fuel banks in towards the andiron to maintain shape of the air spaces 53, 54, 55 and 57 as aforesaid. Ash falls from the inclined burning faces to expose fresh radiant heat sources, thus reducing a tendency of the ash to choke the fire by restricting air flow, similarly to what happened in time with some prior art grates. It has been found that four logs made from compressed wood waste have burned for more than four hours without attention, and newspapers rolled into four imitation logs of about 5 inches in diameter can burn for about three hours, and when burned are reduced to a fine white ash.

DIMENSIONAL CONSIDERATIONS

To achieve the effect outlined previously, there are limits to the angles of inclination of the primary fuel banks, and limits to baffle member height and length in proportion to fuel length. These limits determine many of the dimensions of the andiron. The angle of inclination of the primary fuel banks is preferably between about 20° and 25° to the vertical, but some fuels burn satisfactory when inclined to the vertical at angles of between 15° and 30°. If the angle of inclination is in excess of about 30°, ie less steeply inclined, the combustion gases tend to flow around edges of the primary fuel banks, or through gaps between logs in each fuel bank. This undesirable gas flow would set up convection currents on the outside of the primary fuel banks, radiating heat to the fireplace, removing heat from the combustion zone and decreasing the radiant heat output. If the angle of inclination of the primary fuel is much less than about 15° to the vertical, ie more steeply inclined, the logs may tip outwards, thus destroying the effectiveness of the fire, and also the space for secondary fuel is reduced and the secondary fuel may be consumed too quickly.

The baffle member is spaced above the hearth at a height 46 of between 60 and 70% of the fuel length, but in some cases the andiron performs satisfactorily if the baffle member is positioned at a height of about 55 to 75% of the fuel length. If the baffle member is positioned too high above the hearth, draft restriction is reduced because strong convection currents can be created in the combustion zone below the baffle and excess air will flow into the combustion zone. If the baffle member is positioned too close to the hearth, the space for secondary fuel is reduced and the relatively uniform combustion of the primary fuel banks is not achieved.

The baffle member has a preferred length of between 75 and 80% of the fuel length, but this can be varied under conditions as particularized below. If the baffle member is too short in relation to the fuel length, the volume of the combustion zone is reduced in relation to the area of radiation and heat radiated to the room can be such that the combustion zone is maintained below the desired combustion temperature. If this were the case, the fire would in effect cool itself by radiating excessively and thus would never attain the required temperature for good combustion. If the baffle member is too long in relation to the length of the fuel, heat from the rear of the combustion zone adjacent the fireplace wall cannot be radiated effectively into the room. In some fireplaces that are open on two opposite sides, eg, a fireplace positioned away from walls of a room, it may be desirable to have radiation from both ends of the andiron, and in this case the length of the baffle member could be increased to greater than the fuel length and the desired interaction could be maintained. When the primary fuel length, angle of inclination of the primary fuel and the baffle member height and length are chosen, other dimensions of the andiron are determined. The baffle member has a width 52 defined by the edges 37 and 38 and the positioning members are positioned so that the desired angle of inclination is achieved and the primary fuel banks nearly touch at the apex of the triangle. For a fuel length of 12 inches, typical dimensions could be:

angle of inclination of primary fuel banks to vertical — 23°
height of baffle member — 8 inches
width of baffle member — 2.75 inches
length of baffle member — 10 inches
horizontal spacing between positioning members — 6 inches An alternative approach is to determine the angle of the primary fuel banks by referring to the baffle width 52 in relation to baffle height 46. Assuming upper ends of the logs on one side of the member 23 touch or almost touch upper ends of logs on the opposite side, for a mean angle of inclination 41, 42 of the logs of about 23°, and a mean baffle member height 52 of about 65% of the fuel length, the width 46 would be between about 25 and 50% of the baffle height 52. Thickness of the baffle member is determined primarily by fire resistance requirements rather than strength requirements and is usually less than 25% of the width 52.

ALTERNATIVES AND EQUIVALENTS

If the rear wall 16 of the fireplace is curved, or is unsatisfactory for other reasons as a radiating surface to close the far end of the andiron, a rear plate 59 extending between leg portions and upper portions of the frame member 22 can be fitted. The plate 59 is shown in broken outline in FIG. 2 and closes the far end of the andiron and provides a surface to radiate heat into the room. In any event, at least one end of the frame means 19 should be open to radiate heat into the room.

Figure 5:
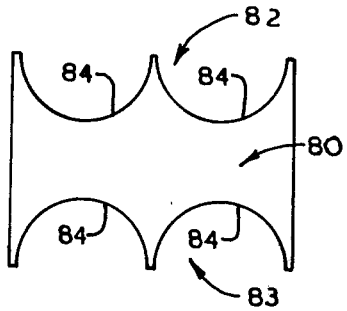
FIG. 5 is a simplified top plan of an alternative baffle member.

The andiron 10 as previously described is simple to make and uses only one pair of positioning members extending between leg portions of the frame members. If desired, two or more pairs of positioning members can be fitted but this has not been found necessary. Alternative means of supporting logs at the desired angle and locating the logs laterally are envisaged as in FIGS. 4 and 5.

FIG. 4

An alternative andiron 60 is shown and this differs from the andiron 10 of FIGS. 1–3 by substituting alternatively shaped frame means and positioning members. The andiron 60 has a frame means 61 including a pair of similar frame members 62 and 63 disposed within spaced parallel vertical planes. The frame member 62 is a generally inverted U-shaped bar 64 having spaced leg portions 65 and 66, an upper portion 67 and corner portions 68 and 69. First and second positioning members 71 and 72 are straight rods and extend between the leg portions of the frame members, and a baffle member 74 extends between the upper portions of the frame members. The baffle member has generally horizontally disposed first and second edges 75 and 76 which, in combination with the positioning members, support the logs at similarly inclined angles as shown for the andiron 10 in FIG. 1.

The corner portion 69 and an opposite corner portion 77 of the member 63 extend upwardly and outwardly from a plane 78, shown in broken outline, which connects the adjacent edge 76 of the baffle member and the adjacent positioning member 72. Logs supported on the members 72 and 74 lie generally parallel to the plane 78 and thus are positioned between the opposed corner portions 69 and 77 which restrict lateral movement of the logs supported on and extending between the particular edge of the baffle member and positioning member. The corner portions on the opposite side of the andiron similarly cooperate with logs positioned therebetween. Thus the corner portions are equivalent to the turned up ends of the positioning members 25 and 26 of FIG. 1 and serve as means adjacent ends of the positioning members to restrict lateral movement of the logs supported on the positioning members.

Other frame means can be devised to cooperate with the baffle member and positioning members to provide the particular relative positions necessary to support the primary fuel banks at the required angle, and to form a self-supporting framework, having at least one open end.

FIG. 5

Figure 4:
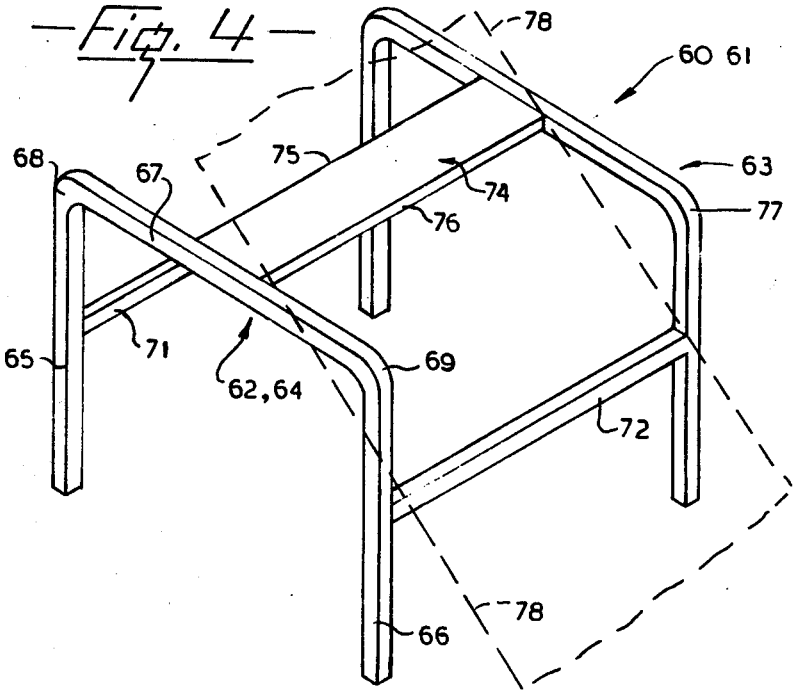
FIG. 4 is a perspective of an alternative andiron.

The baffle members 23 and 74 of FIGS. 1 and 4 are shown as rectangular plates with straight parallel edges and the frame support members restrict lateral movement of the logs. For most fuels, spaces between the logs and edges of the baffle members are sufficient to restrict air flow through the andiron and past the baffle member without completely eliminating this air flow. If the fuel has flat faces resting against the straight edges of the baffle member, air flow restriction past the baffle member would be increased and thus additional clearance openings in the baffle member or along edges of the baffle member would likely be required. If the andiron were to be used only for the burning of logs made from compressed wood waste or rolled newspaper logs, where the number, size and shape of the logs is fairly closely controlled, it might be an advantage to scallop or otherwise change the edges of the baffle member to be generally complementary to the fuel to be used. This could improve draft restriction and one example is to be described.

An alternative baffle member 80 is for use with two similar spaced frame means and positioning members in accordance with FIGS. 1 or 4 or equivalents thereof. The member 80 has a pair of spaced similar scalloped edges 82 and 83 having cut-outs 84 which are complementary to cylindrical logs to be retained therein. This structure provides lateral restriction of upper ends of the logs and improves draft control.

I claim:

1. An andiron for supporting on a hearth first and second primary fuel banks in an inverted V-position, the andiron having:

(a) a baffle member spaced at a baffle height above the hearth and having spaced generally horizontally disposed first and second edges which define a baffle width of between about 25 and 50% of the baffle height, (b) spaced first and second positioning members positioned below the baffle member and spaced laterally relative to each other and the baffle member, (c) frame means connecting the baffle member to the positioning members so as to form a self-supporting framework having at least one open end, and in which the baffle member and the first positioning member on one side of the frame are positioned so that the first fuel bank extends between the first edge of the baffle member and the positioning member and is inclined to the vertical at an angle of inclination, and the second positioning member on the opposite side of the frame is positioned relative to the second edge of the baffle member so as to support the second fuel bank on the opposite side of the frame at a similar angle of inclination, so that when correctly supported on the andiron, the fuel banks form a generally inverted V inclined at the angle of inclination.

2. An andiron as claimed in claim 1 further including:

(a) means adjacent ends of the positioning members to restrict lateral movement of fuel supported on the positioning members.

3. An andiron as claimed in claim 1 in which:

(a) the frame means has a pair of spaced open frame members, each frame member having leg portions and an upper portion, (b) the positioning members extend between the leg portions of the frame members, (c) the baffle member extends between the upper portions of the frame members, (d) the angle of inclination of the fuel banks is between 15° and 30°.

4. An andiron as claimed in claim 1 in which:

(a) the positioning members and the baffle member are disposed generally horizontally, (b) the angle of inclination of the fuel banks is between 15° and 30°.

5. An andiron as claimed in claim 1 in which:

(a) the frame means has a pair of similar open frame members which include generally downwardly curved bars which extend to lower ends thereof disposed within a horizontal plane and adapted to contact the hearth for supporting the andiron thereon, (b) the angle of inclination of the fuel banks is between 15° and 30°.

6. An andiron as claimed in claim 5 in which:

(a) each frame member is a truncated, generally inverted V-shaped bar, the frame members being disposed within spaced parallel vertical planes, (b) the positioning members have upwardly turned end portions to restrict lateral movement of fuel supported on the positioning members, the end portions being secured to the leg portions of the frame members so that the positioning members extend downwardly and inwardly from the frame members.

7. An andiron as claimed in claim 5 in which:

(a) each frame member is generally inverted U-shaped bar having opposed corner portions adjacent upper portions thereof, the corner portions extending upwardly and outwardly from a plane connecting an adjacent edge of the baffle member and the adjacent positioning member, the frame members being disposed within spaced parallel vertical planes, (b) the positioning members are straight rods extending between the leg portions of the frame members, so as to restrict lateral movement of logs supported on and extending between the particular edge and positioning member.

8. An andiron as claimed in claim 7 in which the andiron can support two pairs of equally inclined logs thereon and in which:

(a) the logs are supported at an angle of inclination of between 20° and 25° to the vertical, (b) the baffle member is positioned about 8 inches above the hearth and has a length of about 10 inches and a width of about 2.75 inches, so that upper ends of the logs on opposite sides of the andiron are adjacent each other so as to form the inverted V.

9. An andiron as claimed in claim 1 in which:

(a) the angle of inclination of the fuel supported by the andiron is between 20° and 25° to the vertical.

10. An andiron as claimed in claim 1 in which:

(a) the baffle member is positioned above the hearth at a height of between 55 and 75 percent of maximum length of logs supported on the andiron.

* * * * *